US011906215B2

(12) United States Patent
Ge et al.

(10) Patent No.: US 11,906,215 B2
(45) Date of Patent: Feb. 20, 2024

(54) WATER CHAMBER FOR CONDENSER, CONDENSER HAVING IT AND CHILLER SYSTEM

(71) Applicant: Carrier Corporation, Palm Beach Gardens, FL (US)

(72) Inventors: Zhongnian Ge, Shanghai (CN); Yuling Shi, Shanghai (CN); Hongyi Li, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/746,389

(22) Filed: May 17, 2022

(65) Prior Publication Data

US 2022/0373237 A1 Nov. 24, 2022

(30) Foreign Application Priority Data

May 21, 2021 (CN) ..... 202110557710.4

(51) Int. Cl.
*F25B 39/00* (2006.01)
*F25B 39/04* (2006.01)

(52) U.S. Cl.
CPC ..... *F25B 39/00* (2013.01); *F25B 39/04* (2013.01); *F25B 2339/046* (2013.01); *F25B 2339/047* (2013.01)

(58) Field of Classification Search
CPC ..... F25B 39/00; F28D 7/1638; F28F 9/0202; F28F 2225/08
See application file for complete search history.

(56) References Cited

U.S. PATENT DOCUMENTS 3,223,154 A 12/1965 Goebel
4,047,562 A 9/1977 Weber
(Continued)

FOREIGN PATENT DOCUMENTS

FR 1428131 A * 2/1965
FR 1428131 A 2/1966
KR 20180093055 A * 12/2016

OTHER PUBLICATIONS

Pdf file is original document of foreign reference KR20180093055A (Year: 2016).*

(Continued)

*Primary Examiner* — Henry T Crenshaw
*Assistant Examiner* — Kamran Tavakoldavani
(74) *Attorney, Agent, or Firm* — CANTOR COLBURN LLP

(57) ABSTRACT

A water chamber structure for a condenser, including an orifice plate arranged at one end of the condenser; a water cover fixed to the orifice plate in a sealed manner to form a water storage space; and a partition plate assembly for dividing the water storage space into a water inlet chamber and a water outlet chamber in a sealed manner, including: a first partition plate, the top and side walls of the first partition plate are fixed to the inner walls of the water cover; and a second partition plate, the top of the second partition plate is fixedly connected with the bottom of the first partition plate, the bottom of the second partition plate is fixed to the orifice plate, and the side walls of the second partition plate are connected with the inner walls of the water cover in a sealed manner.

9 Claims, 2 Drawing Sheets

(56) References Cited

U.S. PATENT DOCUMENTS

| | | | | |
|---|---|---|---|---|
| 4,422,499 | A * | 12/1983 | Batistoni | F22B 37/22 165/158 |
| 2002/0148458 | A1 * | 10/2002 | Andress | A47J 37/0718 126/305 |
| 2006/0005940 | A1 | 1/2006 | Dilley et al. | |
| 2018/0224172 | A1 | 8/2018 | Moreaux | |

OTHER PUBLICATIONS

Pdf file is translation of foreign reference FR1428131A (Year: 1965).*
Pdf is translation of foreign reference FR-1428131-A (Year: 1965).*
European Search Report for Application No. 22174608.4; dated Oct. 5, 2022; 7 Pages.

* cited by examiner

WATER CHAMBER FOR CONDENSER, CONDENSER HAVING IT AND CHILLER SYSTEM

FOREIGN PRIORITY

This application claims priority to Chinese Patent Application No. 202110557710.4, filed May 21, 2021, and all the benefits accruing therefrom under 35 U.S.C. § 119, the contents of which in its entirety are herein incorporated by reference.

TECHNICAL FIELD OF INVENTION

The present invention relates to the technical field of heat exchange equipment, in particular to a water chamber structure for a condenser, and also relates to a condenser provided with the water chamber structure for a condenser, and a refrigeration system equipped with the condenser.

BACKGROUND OF THE INVENTION

A heat exchanger, also known as a heat interchanger, is a device that transfers part of the heat of a hot fluid to a cold fluid. Heat exchangers occupy an important position in chemical, petroleum, power, food and many other industrial productions. In chemical production, heat exchangers are widely used, which can be used as heaters, coolers, evaporators and reboilers. It is known to those skilled in the art that a condenser also belongs to a type of heat exchange equipment. In a refrigeration system composed of basic components such as compressor, condenser, throttle valve and evaporator, the refrigerant circulates continuously in the system, and exchanges heat with the outside world through its own phase change. The compressor compresses the working medium from low temperature and low pressure gas into high temperature and high pressure gas, and then condenses it into medium temperature and high pressure liquid through the condenser.

At present, the shell-and-tube condenser for water-cooled HVAC equipment adopts the heat exchange between water and the refrigerant. In the shell and tube of the condenser for heat exchange shown in FIG. 1, the refrigerant is inside the shell, and the water flows through the heat exchange tube. It can be clearly seen from FIG. 1 that an end of the condenser 1 is provided with a water chamber structure 10 for water circulation. As shown in FIG. 2, the water chamber structure 10 is composed of an orifice plate 11, a water cover 12, a separate partition plate 13 and other components. The partition plate 13 is welded to the inner walls of the water cover 12 and the orifice plate 11 of the water chamber structure 10, so as to divide the water chamber structure 10 into a water inlet chamber 14 and a water outlet chamber 15. In order to improve the stiffness of the partition plate 13 and avoid its bending deformation, a reinforcing plate 16 is mounted at the middle part of the partition plate 13 perpendicular to the partition plate 13. However, such a water chamber structure 10 not only easily leads to the failure of the sealing between the partition plate 13 and the orifice plate 11, but also generates a relatively large water flow resistance. Therefore, the thickness of the water cover 12 and the orifice plate 11 cannot be reduced, and the total mass of the water chamber structure 10 is relatively heavy.

Therefore, there is an urgent need to find a water chamber structure for a condenser that can not only improve the overall strength but also reduce the weight while ensuring the tightness.

SUMMARY OF THE INVENTION

In view of the above, according to a first aspect of the present invention, a water chamber structure for a condenser is provided, which effectively solves the above problems and problems in other aspects existing in the prior art. In the water chamber structure for a condenser according to the present invention, the water chamber structure comprises:

- an orifice plate arranged at one end of the condenser;
- a water cover fixed to the orifice plate in a sealed manner to form a water storage space; and
- a partition plate assembly for dividing the water storage space into a water inlet chamber and a water outlet chamber in a sealed manner, the partition plate assembly comprising:
- a first partition plate, wherein the top and side walls of the first partition plate are fixed to the inner walls of the water cover; and
- a second partition plate, wherein the top of the second partition plate is fixedly connected with the bottom of the first partition plate, the bottom of the second partition plate is fixed to the orifice plate, and the side walls of the second partition plate are connected with the inner walls of the water cover in a sealed manner.

In another embodiment of the water chamber structure for a condenser according to the present invention, the first partition plate is provided with a convex portion protruding toward the water inlet chamber.

In yet another embodiment of the water chamber structure for a condenser according to the present invention, the first partition plate is provided with a convex portion protruding toward the water outlet chamber.

In still another embodiment of the water chamber structure for a condenser according to the present invention, the first partition plate and the second partition plate are arranged in parallel with each other.

In another embodiment of the water chamber structure for a condenser according to the present invention, the top and side walls of the first partition plate are fixed to the inner walls of the water cover by welding.

In yet another embodiment of the water chamber structure for a condenser according to the present invention, the bottom of the second partition plate is fixed to the orifice plate by welding, and the top of the second partition plate and the bottom of the first partition plate are fixed by bolts.

In another embodiment of the water chamber structure for a condenser according to the present invention, materials of the first partition plate and the second partition plate are the same.

In yet another embodiment of the water chamber structure for a condenser according to the present invention, the first partition plate and the second partition plate are both made of steel.

In still another embodiment of the water chamber structure for a condenser according to the present invention, the water cover is provided with a water inlet on one side of the water inlet chamber, and is provided with a water outlet on one side of the water outlet chamber.

In addition, according to a second aspect of the present invention, a condenser provided with the aforementioned water chamber structure for a condenser is further provided.

Furthermore, according to a third aspect of the present invention, a refrigeration system comprising the aforementioned condenser is further provided.

It can be appreciated that the water chamber structure for a condenser according to the present invention can improve the overall strength while ensuring the tightness, so that the deformation of the water chamber structure is restrained, and wall thickness of the water cover and/or orifice plate is reduced so as to reduce the overall weight of the water chamber structure. In addition, the water chamber structure can make the water flow more evenly distributed, thereby improving the heat exchange efficiency.

BRIEF DESCRIPTION OF THE DRAWINGS

The technical solutions of the present invention will be described in further detail below in conjunction with the accompanying drawings and embodiments, wherein.

DETAILED DESCRIPTION OF THE INVENTION

Some embodiments of the present invention will be described in detail below with reference to the accompanying drawings. It should be noted that orientation terms such as upper, lower, left, right, front, rear, inner side, outer side, top and bottom mentioned or possibly mentioned in this specification are defined relative to the configurations illustrated in the respective drawings. They are relative concepts, so they may change accordingly according to their different locations and different states of use. Therefore, these and other orientation terms shall not be construed as restrictive terms.

Figure 1:
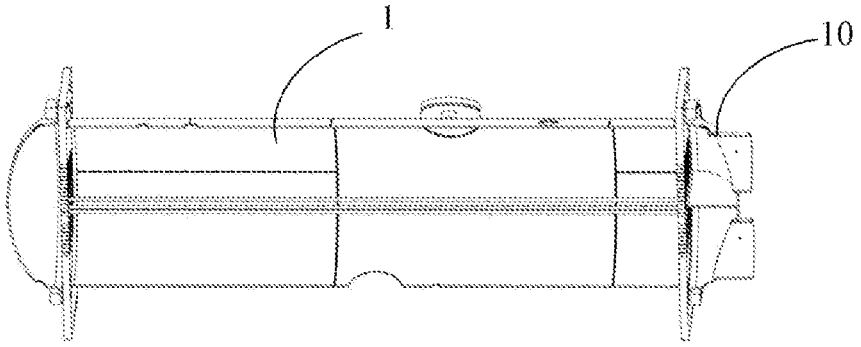
FIG. 1 shows a perspective structural schematic diagram of a condenser according to the prior art.
Figure 2:
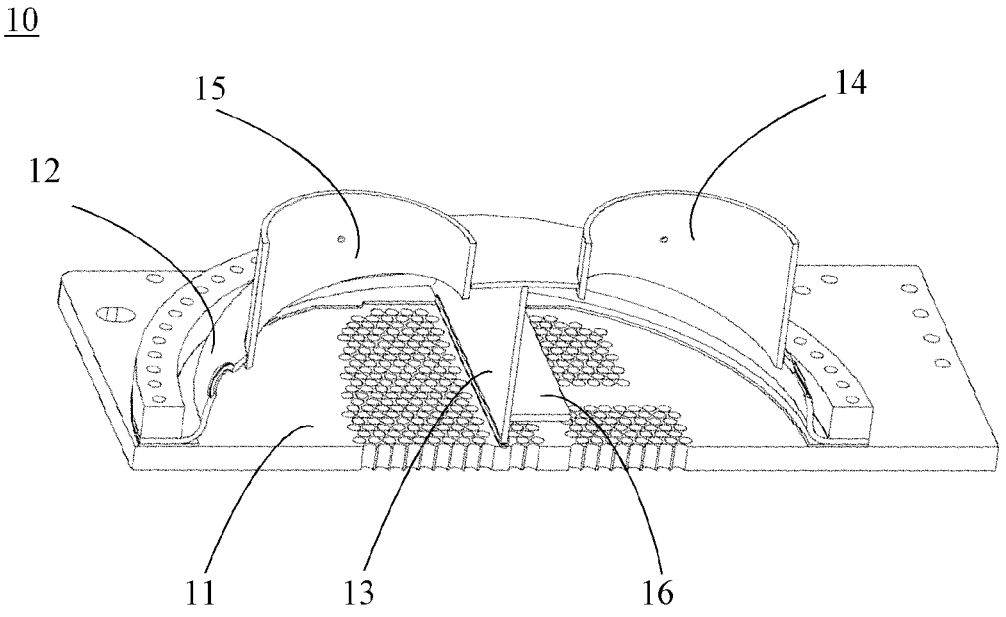
FIG. 2 shows a partial perspective structural schematic diagram of a water chamber structure for a condenser according to the prior art.
Figure 3:
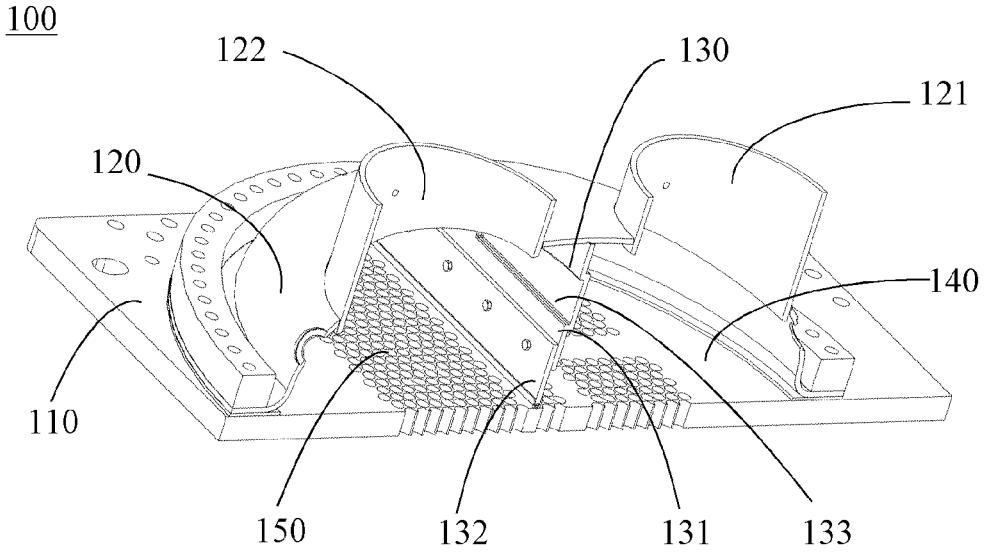
FIG. 3 shows a partial perspective structural schematic diagram of an embodiment of a water chamber structure for a condenser according to the present invention.

As shown in FIG. 3, it schematically illustrates the structure of an embodiment of the water chamber structure for a condenser according to the present invention in general. As can be clearly seen from FIG. 3, a water chamber structure 100 for a condenser is composed of an orifice plate 110, a water cover 120, a partition plate assembly 130 and other components. Wherein, the orifice plate 110 is arranged on one end of the condenser, and the water cover 120 is fixed to the orifice plate 110 in a sealed manner to form a water storage space. The main function of the partition plate assembly 130 is to divide the water storage space into a water inlet chamber 140 and a water outlet chamber 150 in a sealed manner. Specifically, the partition plate assembly 130 comprises a first partition plate 131 and a second partition plate 132. Wherein, the top and side walls of the first partition plate 131 are fixed to the inner walls of the water cover 120, and the second partition plate 132 is located below the first partition plate 131. Wherein, the bottom of the second partition plate 132 is fixed to the orifice plate 110, and the side walls of the second partition plate 132 are connected with the inner walls of the water cover 120 in a sealed manner. For example, the side walls of the second partition plate 132 can be closely fitted with the inner walls of the water cover 120 or be closely connected with the inner walls of the water cover 120 by means of rubber pads (not shown). The top of the second partition plate 132 is fixedly connected with the bottom of the first partition plate 131 by bolts, for example. In the partition plate assembly 130, the number and positions of the bolts can be designed according to actual requirements, as long as the tightness of the connection between the first partition plate 131 and the second partition plate 132 is ensured.

It can be appreciated that, the water chamber structure in the aforementioned embodiment can improve the integrity of the water chamber structure while ensuring the tightness. Compared with the prior art, such a water chamber structure can use a water cover and/or an orifice plate with a thinner wall thickness, thereby helping to reduce the weight of the water chamber structure and thus the overall weight of the condenser. On the other hand, such a water chamber structure can make the water flow evenly distributed, so that the heat exchange performance is greatly improved.

In a preferred embodiment of the present invention, the first partition plate 131 is provided with a convex portion 133 protruding toward the water inlet chamber 140, that is, the first partition plate 131 has a concave portion in the water outlet chamber 150 to achieve a relatively high structural rigidity. It should be pointed out that the cross-sectional shape of the convex portion 133 can be designed into a regular shape, such as arc, circle, ellipse or square, or can be designed into an irregular shape, such as a special shape. Use of the aforementioned convex portion can effectively change the flow direction of the water flow, so that the water flow entering the water storage space is more evenly distributed, thereby reducing the pressure loss. As an alternative embodiment, the convex portion of the first partition plate 131 may also be configured to protrude toward the water outlet chamber 150, that is, the first partition plate 131 has a concave portion in the water inlet chamber 140.

Those skilled in the art can appreciate that, the first partition plate 131 and the second partition plate 132 can be arranged to be parallel with each other (refer to FIG. 3), so as to facilitate the operator to assemble.

In addition, in order to ensure the tightness of the water inlet chamber 140 and the water outlet chamber 150, the top and side walls of the first partition plate 131 can be fixed to the inner walls of the water cover 120 by welding. Furthermore, the bottom of the second partition plate 132 can be fixed to the orifice plate 110 by welding. It should be noted that the partition plate assembly 130 is assembled in the water chamber structure 100 by welding, so that the integrity of the water chamber structure 100 is enhanced, and thus the deformation of the water chamber structure 100 is further restrained.

As an example, the water cover 120 is provided with a water inlet 121 on one side of the water inlet chamber 140, and is provided with a water outlet 122 on one side of the water outlet chamber 150, as shown in FIG. 3.

To sum up, compared with the prior art, the water chamber structure for a condenser according to the present invention can achieve better tightness under the same pressure difference. In addition, since the integrity of the partition plate assembly is enhanced, the water chamber structure is more strongly constrained, so that thinner water cover and/or orifice plate can be used, thereby reducing the overall weight of the water chamber structure.

In addition, the present invention provides a condenser provided with the aforementioned water chamber structure for a condenser. Since the water chamber structure is arranged inside the condenser, the water flow inside the condenser is more uniform. Verified by the engineering simulation software CFD (Computational Fluid Dynamics), the water chamber structure can reduce the overall pressure drop and improve the uniformity of the flow velocity between the heat exchange pipes, thus achieving better heat exchange performance.

In addition, the present invention also provides a refrigeration system equipped with the aforementioned condenser. The refrigeration system comprises a cooling tower, a water chiller, a pumping device and the like that are connected by pipelines, wherein, the water chiller is composed of components such as compressor, condenser, throttling device and evaporator. As mentioned above, the condenser provided with the aforementioned water chamber structure helps to improve the heat exchange performance, so it is highly recommended to apply the aforementioned condenser to various refrigeration systems.

Some specific embodiments are listed above to illustrate in detail a water chamber structure for a condenser, a condenser provided with the water chamber structure for a condenser and a refrigeration system equipped with the condenser according to the present invention. These individual examples are only used to illustrate the principle of the present invention and the implementations thereof, but not to limit the present invention. Those skilled in the art may, without departing from the spirit and scope of the present invention, make various modifications and improvements. For example, for the purpose of manufacturing convenience, the first partition plate 131 and the second partition plate 132 can use the same material, for example, the first partition plate 131 and the second partition plate 132 can both be made of high-strength steel or other materials. Therefore, all equivalent technical solutions shall belong to the scope of the present invention and be defined by the respective claims of the present invention.

What is claimed is:

1. A water chamber structure for a condenser, the water chamber structure comprising:

an orifice plate;

a water cover fixed to the orifice plate in a sealed manner to form a water storage space; and a partition plate assembly for dividing the water storage space into a water inlet chamber and a water outlet chamber in a sealed manner, wherein the partition plate assembly comprises:

a first partition plate, wherein top and side walls of the first partition plate are fixed to inner walls of the water cover; and a second partition plate, wherein top of the second partition plate is fixedly connected with bottom of the first partition plate, bottom of the second partition plate is fixed to the orifice plate, and side walls of the second partition plate are connected with the inner walls of the water cover in a sealed manner;

wherein the first partition plate is provided with a convex portion protruding toward the water inlet chamber or protruding toward the water outlet chamber.

2. The water chamber structure according to claim 1, wherein the first partition plate and the second partition plate are arranged in parallel with each other.

3. The water chamber structure according to claim 1, wherein the top and side walls of the first partition plate are fixed to the inner walls of the water cover by welding.

4. The water chamber structure according to claim 1, wherein the bottom of the second partition plate is fixed to the orifice plate by welding, and the top of the second partition plate and the bottom of the first partition plate are fixed by bolts.

5. The water chamber structure according to claim 1, wherein materials of the first partition plate and the second partition plate are the same.

6. The water chamber structure according to claim 5, wherein the first partition plate and the second partition plate are both made of steel.

7. The water chamber structure according to claim 1, wherein the water cover is provided with a water inlet on one side of the water inlet chamber, and is provided with a water outlet on one side of the water outlet chamber.

8. A condenser, wherein the condenser is provided with the water chamber structure according to claim 1.

9. A refrigeration system, wherein the refrigeration system comprises the condenser according to claim 8.

* * * * *